US008275272B2

(12) United States Patent
Stuckey et al.

(10) Patent No.: US 8,275,272 B2
(45) Date of Patent: Sep. 25, 2012

(54) METHOD AND APPARATUS FOR PRINTING

(75) Inventors: Aaron Michael Stuckey, Fairport, NY (US); Karl Edwin Kurz, Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 434 days.

(21) Appl. No.: 12/473,374

(22) Filed: May 28, 2009

(65) Prior Publication Data

US 2010/0303480 A1 Dec. 2, 2010

(51) Int. Cl.
*G03G 15/00* (2006.01)

(52) U.S. Cl. ..... 399/26; 399/11; 399/31; 399/111; 399/116

(58) Field of Classification Search ..... 399/9, 11, 399/24–26, 31, 110, 111, 116
See application file for complete search history.

(56) References Cited

U.S. PATENT DOCUMENTS

| | | | | |
|---|---|---|---|---|
| 5,778,279 | A * | 7/1998 | Kawai et al. | 399/42 |
| 6,975,817 | B2 * | 12/2005 | Rommelmann et al. | 399/24 |
| 2004/0257609 | A1 * | 12/2004 | Tokimatsu | 358/1.15 |
| 2004/0265715 | A1 * | 12/2004 | Itami et al. | 430/58.05 |
| 2006/0204259 | A1 * | 9/2006 | Watanabe et al. | 399/44 |

* cited by examiner

*Primary Examiner* — Walter L Lindsay, Jr.
*Assistant Examiner* — Jessica L Eley
(74) *Attorney, Agent, or Firm* — Oliff & Berridge, PLC

(57) ABSTRACT

Aspects of the disclosure can provide a method for replacing a customer replaceable unit (CRU) in a printing system. The method can include determining a historic usage pattern for a CRU during a usage of the CRU, calculating a remaining time for the CRU based on the historic usage pattern, and signaling a user for ordering a new CRC when the remaining time for the CRU is substantially equivalent to a pre-determined value.

14 Claims, 3 Drawing Sheets

METHOD AND APPARATUS FOR PRINTING

BACKGROUND

A printing system may include one or more customer replaceable unit (CRU). For example, a printing system may include a photoreceptor drum cartridge that can be replaced by customers. More specifically, when the outer surface of the photoreceptor drum cartridge wears away as pages are printed, customers can replace the worn-out photoreceptor drum cartridge with a new photoreceptor drum cartridge.

SUMMARY

Aspects of the disclosure can provide a method for replacing a customer replaceable unit (CRU) in a printing system. The method can include determining a historic usage pattern for a CRU during a usage of the CRU, calculating a remaining time for the CRU based on the historic usage pattern, and signaling a user for ordering a new CRU when the remaining time for the CRU is substantially equivalent to a pre-determined value.

To determine the historic usage pattern for the CRU during the usage of the CRU, the method can include periodically measuring a usage attribute of the CRU during the usage of the CRU. Further, the method can include determining the historic usage pattern based on at least one of a linear model, a polynomial model, and a least square fitting algorithm. In addition, the method can include calculating a historic wear rate.

In an embodiment, the CRU can be a photoreceptor module, and the usage attribute can be an imaging layer thickness of the photoreceptor module. Then, the method can further include periodically measuring the imaging layer thickness of the photoreceptor module according to saturation charging.

To calculate the remaining time for the CRU based on the historic usage pattern, the method can include dynamically calculating the remaining time for the CRU based on the historic usage pattern that is updated with a most recent measurement of the usage attribute. Further, the method can include obtaining a parameter of maximum wear amount from the CRC in order to calculate the remaining time.

Aspects of the disclosure can provide a printing system. The printing system can include a photoreceptor module configured to be replaceable, a monitor module configured to measure a usage attribute of the photoreceptor module, and a controller module configured to determine a historic usage pattern for the photoreceptor based on the measured usage attribute of the photoreceptor module, calculate a remaining time for the photoreceptor module based on the historic usage pattern, and signal a user for ordering a new photoreceptor module when the remaining time for the photoreceptor module is substantially equivalent to a pre-determined value.

In an embodiment, the monitor module can be configured to periodically measure the usage attribute of the photoreceptor module. Further, the controller module can be configured to determine the historic usage pattern based on at least one of a linear model, a polynomial model, and a least square fitting algorithm.

According to an aspect of the disclosure, the photoreceptor module can include a memory medium storing a parameter of maximum wear amount of the photoreceptor module. Further, the usage attribute can be an imaging layer thickness of the photoreceptor module. Thus, the monitor module can be configured to measure the imaging layer thickness of the photoreceptor module according to saturation charging.

In addition, the controller module can be configured to dynamically calculate the remaining time for the photoreceptor module based on the historic usage pattern that can be updated with a most recent usage attribute measurement.

Aspects of the disclosure can provide a computer readable medium storing program instructions for causing a controller to perform customer replaceable unit (CRU) optimization steps. The CRU optimization steps can include determining a historic usage pattern for a CRU during a usage of the CRU, calculating a remaining time for the CRU based on the historic usage pattern, and signaling a user for ordering a new CRU when the remaining time for the CRU is substantially equivalent to a pre-determined value.

Further, the CRU optimization steps can include periodically controlling a monitor module to measure a usage attribute of the CRU during the usage of the CRU. In addition, the CRU optimization steps can include determining the historic usage pattern based on at least one of a linear model, a polynomial model, and a least square fitting algorithm.

In an embodiment, the CRU optimization steps can include calculating a historic wear rate based on an initial usage attribute and a most recent measurement of the usage attribute.

BRIEF DESCRIPTION OF THE DRAWINGS

Various exemplary embodiments of this disclosure will be described in detail with reference to the following figures, wherein like numerals reference like elements, and wherein.

EMBODIMENTS

Figure 1:
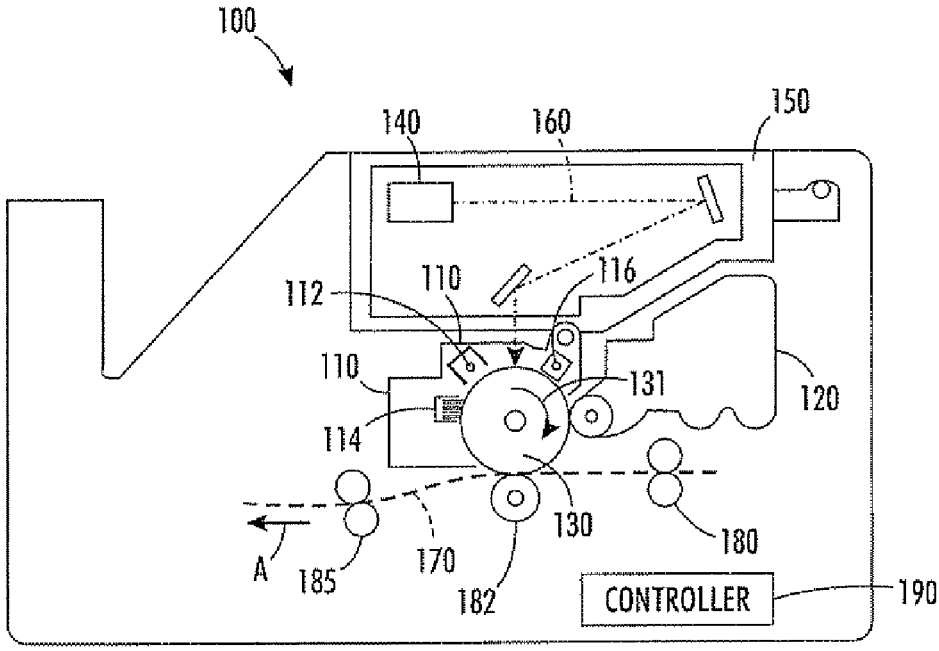
FIG. 1 shows an exemplary printing system according to an embodiment of the disclosure.

FIG. 1 shows a cross section view of an exemplary printing system according to an embodiment of the disclosure. The printing system 100 can include various components, such as a photoreceptor drum cartridge 110, a developer cartridge 120, a scanner module 150, a feeding module 180, a transfer module 182, a fusing module 185, and the like, that can support creating desired images. These elements can be coupled as shown in FIG. 1.

The photoreceptor drum cartridge 110 can include a photoreceptor member, such as a photoreceptor drum 130. The photoreceptor drum 130 can be coated with a layer of photoconductive material. The photoreceptor drum 130 can move in a direction of arrow 131 to advance successively to other components, either within the photoreceptor drum cartridge 110, or coupled to the photoreceptor drum cartridge 110.

Additionally, the photoreceptor drum cartridge 110 may include other components, such as a cleaning module 114, a charging module 112, and the like. The cleaning module 114 can remove particles, such as residue toner particles, from the surface of the photoreceptor drum 130. The charging module 112 can prepare the surface of the photoreceptor drum 130 with electrical charges for subsequent printing process. More specifically, the charging module 112 can produce electric fields, such as corona, to charge the surface of the photoreceptor dram 130 to a substantial uniform potential.

In an embodiment, the photoreceptor drum cartridge 110 can include a memory medium, such as a memory chip. The memory medium may store various information of the photoreceptor drum cartridge 110, such as type of the drum cartridge, an initial thickness of the photoconductive layer, maximum wearable amount of the photoconductive layer, and the like. The various information can be read by the printing system 100, for example, at an installation time.

In an embodiment, the photoreceptor drum cartridge 110 may also include a monitor module 116. The monitor module 116 can measure a usage attribute of the photoreceptor drum 130, such as a thickness of the photoconductive layer at the outside surface of the photoreceptor drum 130. In another embodiment, the monitor module 116 may be located outside of the photoreceptor drum cartridge 110, and can be coupled to the photoreceptor drum cartridge 110 to measure, for example, the thickness of the photoconductive layer.

The photoconductive layer can wear away as pages are printed. As the photoconductive layer wears out, the thickness of the photoconductive layer can be reduced, and performance characteristics of the photoconductive layer, such as charging density, charging uniformity, and the like, can be affected. Further, the printing quality of the printing system 100 can be affected.

To ensure printing quality, the photoreceptor drum cartridge 110 can be configured as a customer replaceable unit (CRU) that can be replaced by a user of the printing system 100 according to an embodiment of the disclosure. The printing system 100 may characterize a historic usage pattern of the photoreceptor dram cartridge 110, for example, based on periodic thickness measurements of the photoconductive layer, and determine a remaining time for the photoreceptor drum cartridge 110 based on the historic usage pattern. In an embodiment, the photoreceptor dram cartridge 110 may include a parameter of maximum wear amount, for example, in a memory chip. The maximum wear amount can be used to determine the remaining time for the photoreceptor drum cartridge 110.

In addition, the printing system 100 may determine a signal time. For example, when the remaining time for the photoreceptor drum cartridge 110 is substantially equivalent to a pre-determined value, which may be set by an operator of the printing system 100 based on an order-delivery time duration for a new photo receptor drum, the printing system 100 may inform the operator to order a new photoreceptor cartridge. Thus, the user may have enough time to order the new photoreceptor drum cartridge, and can keep a reduced stock time for stocking the new photoreceptor drum cartridge before the photoreceptor drum cartridge in use, wears away.

The scanner module 150 can include a light emitting device 140, such as a semiconductor laser device, to emit a light beam having an intensity corresponding to a desired image. The light beam can pass through an optical system, as shown by a light path 160 in FIG. 1, and scan the surface of the photoreceptor drum 130. Therefore, the electric potential of the photoreceptor drum 130 can be modified by the light beam to create an electrostatic latent image.

The developer cartridge 120 may include one or more developers. A developer can bring a developing material, such as toner particles, in contact with the electrostatic latent image on the surface of the photoreceptor drum 130. The toner particles can be attached to the surface of the photoreceptor drum 130 according to the electrostatic latent image to create a toner image.

The feeding module 180 can feed a supporting sheet, such as a piece of paper, to the transfer module 182. Then, the transfer module 182 can transfer a toner image from the surface of the photoreceptor drum 130 to the supporting sheet. Further, the supporting sheet can be transported to the fusing module 185. The fusing module 185 can permanently fuse the toner image on the supporting sheet.

Additionally, the printing system 100 may include a controller 190. The controller 190 can be coupled with components of the printing system 100, and can enable the printing system 100 to operate according to the disclosure. In an example, the controller 190 may be coupled to the photoreceptor drum 130, the charging module 112 and the monitor module 116 to measure a photoconductive layer thickness of the photoreceptor drum 130 according to a saturation charging method. More specifically, the controller 190 may control the charging module 112 to charge the photoconductive layer into a saturation state. Then, the controller 190 can control the monitor module 116 to measure, for example, a surface potential of the photoreceptor drum 130. The surface potential can be inversely proportional to the thickness of the photoconductive layer. Thus, the photoconductive layer thickness can be calculated based on the measured surface potential.

During operation, for example, when a new photoreceptor drum cartridge is first installed, an initial thickness of the photoconductive layer of the new photoreceptor drum cartridge can be measured and recorded. In another example, the initial thickness of the photoconductive layer may be pre-calibrated and stored in a memory chip within the photoreceptor drum cartridge. The memory chip may also store other information about the photoreceptor drum cartridge, such as the maximum wear amount, and the like. The information in the memory chip can be read by the printing system 100 when the new photoreceptor drum cartridge is first installed.

Then, the newly installed photoreceptor drum cartridge 130 can be used for printing pages. More specifically, the surface of the photoreceptor drum 130 can turn to the cleaning module 114. The cleaning module 114 can remove residue toner particles from a previous printing. Then, the surface of the photoreceptor drum can move to the charging module 112. The charging module 112 can charge the surface of the photoreceptor drum 130 to a substantially uniform potential. Subsequently, the surface of the photoreceptor drum 130 can move to face light emitted from the scanner module 150. The light from the scanner module 150 can dissipate the charges on the surface of the photoreceptor drum 130 according to a desired image to produce an electrostatic latent image.

Further, a developer of the developer cartridge 120 can apply toner particles to the surface of the photoreceptor drum 130. The toner particles can adhere to the surface of the photoreceptor drum 130 according to the electrostatic latent image, and thereby create a toner image. The toner image can then be transferred to a supporting sheet. In another example, the toner image can be first transferred to an intermediate belt, or any other intermediate mechanism. Then, the intermediate belt or any other intermediate mechanism can transfer the toner image to a supporting sheet.

When the above operations are repetitively executed as pages are printed, the photoconductive layer on the outer surface of the photoreceptor drum 130 can wear away, and the thickness of the photoconductive layer can be reduced. The thickness of the photoconductive layer may be measured at different times, such as periodically. According to an aspect of the disclosure, the thickness of the photoconductive layer may be measured according to the saturation charging method. The measured thickness of the photoconductive layer can be provided to the controller 190. The controller 190 can characterize a historic usage pattern of the photoreceptor drum cartridge 110 based on the measured thickness at different times. Then, the controller 190 can use the historic usage pattern to predict a remaining time of the photoreceptor drum cartridge 110. Further, the controller 190 may determine whether to signal a user of the printing system to order a new photoreceptor drum cartridge 110. For example, when the remaining time is substantially equivalent to a pre-determined value, the controller 190 may signal the user to order a new photoreceptor drum cartridge. The predetermined value can be decided and set by the user based on the order-delivery time duration of a new photoreceptor drum cartridge.

It is noted that the FIG. 1 example uses the photoreceptor drum cartridge 110 as an exemplary CRU for ease and clarity, the disclosed methods and apparatuses can be suitably adjusted for other types of CRUs, such as developer cartridge, and the like.

In addition, for ease and clarity, the printing system 100 shown in FIG. 1 includes a single photoreceptor drum cartridge 110 directing prints to a paper. It is noted that a printing system may include multiple photoreceptor drum cartridges. In addition, the printing system may include an intermediate transfer belt coupled to the multiple photoreceptor drum cartridges. Further, the multiple photoreceptor drum cartridges can be configured to build a toner image on the intermediate transfer belt. Then, the intermediate transfer belt can transfer the image to a paper.

It is also noted that the disclosed methods and apparatuses can be suitably adjusted for the multiple photoreceptor drum cartridges. In an example, the controller 190 can receive thickness measurements of each of the multiple photoreceptor drum cartridges, and determine a historic usage pattern for each of the multiple photoreceptor drum cartridges. Further, the controller 190 can use the historic usage pattern to predict a remaining time of each of the multiple photoreceptor drum cartridges independently. In addition, the controller 190 may determine to signal the user of the printing system to order a new photoreceptor drum cartridge for replacing a specific photoreceptor drum cartridge if the remaining time of the specific photoreceptor drum cartridge is substantially equivalent to a pre-determined value.

It is also noted that the charging module 112 can be configured based on various charging techniques, such as contacting charging technique, non-contacting charging technique, and the like. In an example, the charging module 112 may include a bias charge roller (BCR) that uses a contacting charging technique.

Figure 2:
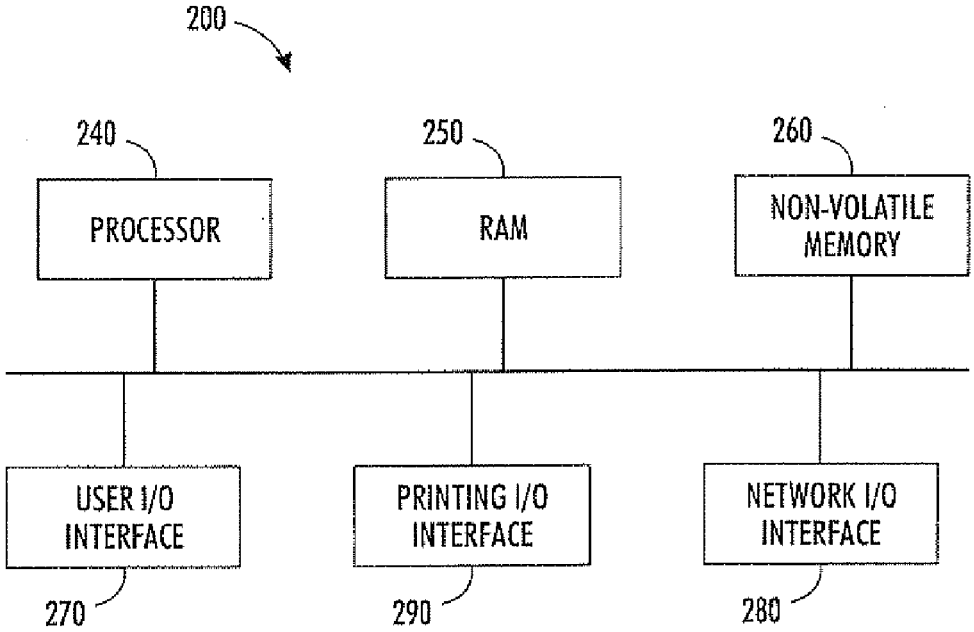
FIG. 2 shows an exemplary controller for determining a remaining time of a customer replaceable unit (CRU) according to an embodiment of the disclosure.

FIG. 2 shows an exemplary controller for determining a remaining time of a customer replaceable unit (CRU) according to an embodiment of the disclosure. The controller 200 can include various components, such as a processor 240, a non-volatile memory unit 260, a RAM unit 250, a printing interface 290, a user interface 270, a network interface 280, and the like. These components can be coupled together as shown in FIG. 2.

The processor 240 can execute system and application codes. More specifically, the processor 240 may execute codes for controlling various printing components, such as the cleaning module 114, the charging module 112, the photoreceptor drum 130, the scanner module 140, and the like, in FIG. 1 example, in cooperation to print pages. In addition, the processor 240 may execute codes for controlling a monitor module, such as the monitor module 116 in FIG. 1 example, to measure a usage attribute, such as the thickness of the photoconductive layer, at different times. The processor 240 can then execute codes to characterize a historic usage pattern based on the measurements of the usage attributes. Further, the processor 240 can determine a remaining time of the CRU, and can control a signal mechanism, such as a display mechanism, and the like, to inform a user to order a new CRU when the remaining time is substantially equivalent to a pre-determined value.

The non-volatile memory unit 260 can store system and application codes that generally do not change, such as firmware. The RAM unit 250 is writeable and readable, and can be accessed at a fast speed. It can be preferred that data and codes are in the RAM unit 250 for the processor 240 to access during operation. The user interface 270 can couple the controller 200 with user interaction modules, such as a display screen, a key pad, and the like. The printing interface 290 can enable the controller 200 to communicate with the various printing components. The network interface 280 can enable the controller 200 to communicate with other devices on a network, for example, to receive printing jobs from other devices.

During operation, the controller 200 may receive a printing job, for example from the network interface 280. Then, the controller 200 may control the various printing components to perform the printing job via the printing interface 290. Additionally, the controller 200 may control the monitor module to measure the usage attribute of the CRU at different times. In an example, the controller 200 may control the monitor module to measure an initial usage attribute when the CRU is first installed. In another example, the controller 200 may read an initial usage attribute from a memory chip with the CRU.

Then the controller 200 can control the monitor module to periodically measure the usage attribute of the CRU. The measurements at different times can be used by the controller 200 to characterize a historic usage pattern. The controller 200 may use various models, such as a linear model, a polynomial model, a least square fitting model, and the like, to characterize the historic usage pattern. Further, the historic usage pattern can be used by the controller 200 to predict a remaining time of the CRU. When the remaining time of the CRU is substantially equivalent to a pre-determined threshold value, the controller 200 may inform the user of the printing system to order a new CRU.

It is noted that while the controller 200 in FIG. 2 example is implemented by a processor executing software codes, the controller 200 can also be implemented by suitable hardware only.

In an example, a linear model can be used by the controller 200 to characterize the historic usage pattern. The linear model can be constructed by various modeling techniques. In an example, the linear model can be constructed by a least square fitting model. In another example, the linear model can be constructed by two measurements of the usage attribute at different times, such as the most recent two measurements, or an initial measurement and a most recent measurement. Eq. 1 shows a linear model constructed by an initial measurement and a most recent measurement:

$$Life_{remain} = \left(1 - \frac{T_0 - T_m}{M}\right) \times 100\% \qquad \text{Eq. 1}$$

where $Life_{remain}$ denotes a remaining life in percentage of the CRU, $T_0$ denotes an initial measurement result of the usage attribute, $T_m$ denotes a most recent measurement result of the usage attribute, and M denotes a maximum wear that can be allowed. Eq. 2 shows an equation for calculating a remaining time of the CRU according to the linear model:

$$Time_{remain} = (t_m - t_0) \times \left(\frac{M}{T_0 - T_m} - 1\right) \quad \text{Eq. 2}$$

where $Time_{remain}$ denotes the remaining time of the CRU, $t_0$ denotes the time of the initial measurement or the time the CRU is installed, and $t_m$ denotes the time of the most recent measurement. In an embodiment, the remaining time may indicate a number of days that the presently installed CRU can provide quality printings.

Figure 3:
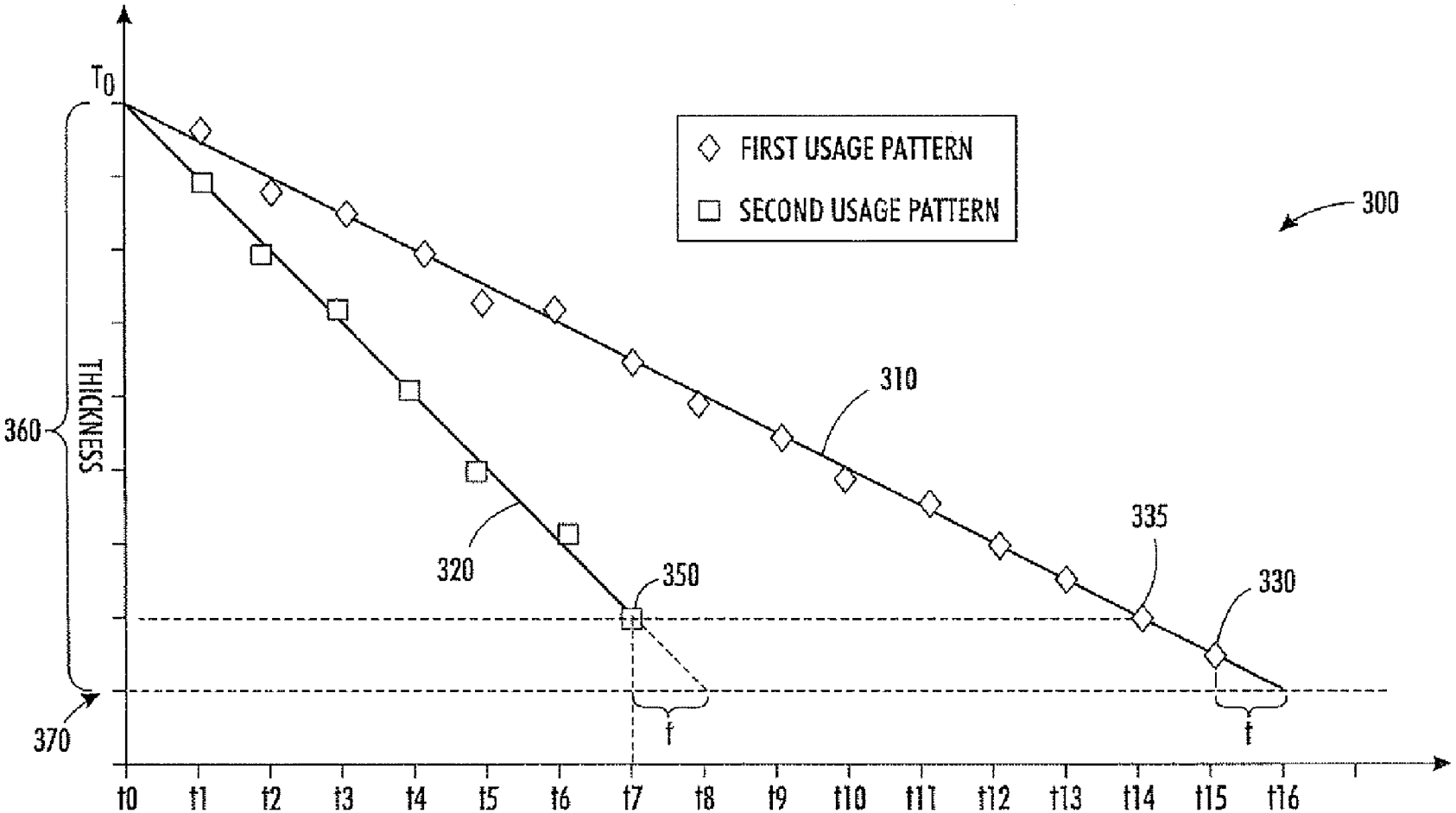
FIG. 3 shows an exemplary plot for determining a historic usage pattern for a CRU according to an embodiment of the disclosure.

FIG. 3 shows an exemplary plot for determining a historic usage pattern for a photoreceptor drum cartridge according to an embodiment of the disclosure. The historic usage pattern of the photoreceptor drum cartridge can be characterized by thickness measurements of a photoconductor layer, which may be coated on a photoreceptor drum of the photoreceptor drum cartridge. The plot 300 can show a trend of measured thickness over time.

According to an embodiment of the disclosure, the thickness measurement may be performed initially when a photoreceptor drum cartridge is first installed. Additionally, the thickness measurement may be performed periodically. In an example, a printing system may include a monitor module coupled to the photoreceptor drum cartridge. The monitor module can be controlled by a controller to measure the thickness of the photoconductive layer, for example, by a saturation charge method. The monitor module may provide the measured thickness to the controller.

According to an embodiment, the controller may characterize a historic usage pattern based on the thickness measurements. In an example, the controller may characterize the historic usage pattern based on the initial measurement and a most recent measurement, for example, by a linear model. In another example, the controller may characterize the historic usage pattern based on two or more most recent measurements. The controller may characterize the historic usage pattern by any suitable models, such as a linear model, a polynomial model, and the like. In addition, the controller may characterize the historic usage pattern by any suitable fitting method, such as a least square fitting method, and the like.

In the FIG. 3 example, the historic usage pattern can be characterized by a linear model using the initial measurement and a most recent measurement of the photoconductive layer thickness. According to an aspect of the disclosure, different users may have different usage patterns. The plot 300 can show a first usage pattern and a second usage pattern corresponding to a first user and a second user respectively. The first user may use a first printing system, and the second user may user a second printing system. The first printing system and the second printing system may use the same type of photoreceptor drum cartridges. According to the FIG. 3, the second user may more heavily use the second printing system comparing to the first user using the first printing system. Therefore, the first usage pattern may have a smaller slope than the second usage pattern, as shown in FIG. 3.

Further, the controller may determine a time for signaling the user to order a new photoreceptor drum cartridge. According to the disclosure, the controller may determine the time to signal the user based on a maximum wear, shown as 360 in FIG. 3. When the maximum wear has been reached, the photoreceptor drum cartridge may be considered as exhausted that can affect printing quality. In an example, the controller may determine the time to signal the user with a pre-determined time margin to the time that the photoreceptor can be exhausted. The pre-determined time margin may be decided and set by the user based on an order-delivery time for a new photoreceptor drum cartridge.

In the FIG. 3 example, the photoreceptor drum cartridge in the first printing system can be predicated to be exhausted at time t16 using the first usage pattern, and the photoreceptor drum cartridge in the second printing system can be predicted to be exhausted at time t8 using the second usage pattern. When the pre-determined time margin is t, a controller in the first printing system may signal the user for ordering a new photoreceptor drum cartridge at time t15, and a controller in the second printing system may signal the user for ordering a new photoreceptor drum cartridge at time t7.

In a related art, a controller signals a user to order a new photoreceptor drum cartridge when a substantially constant number of pages are printed. When a printing system is lightly used, for example, similar to the first usage pattern in FIG. 3, the controller may signal the user to order a new photoreceptor drum cartridge when the present photoreceptor drum cartridge still has a plenty of remaining time. Thus, the newly ordered photoreceptor drum cartridge may be stocked for a long time before installation. On the other hand, when a printing system is heavily used, for example, similar to the second usage pattern in FIG. 3, the controller may signal the user to order a new photoreceptor drum cartridge when the present photoreceptor drum cartridge has a short remaining time, which may not be enough before the newly ordered photoreceptor drum cartridge is available.

Figure 4:
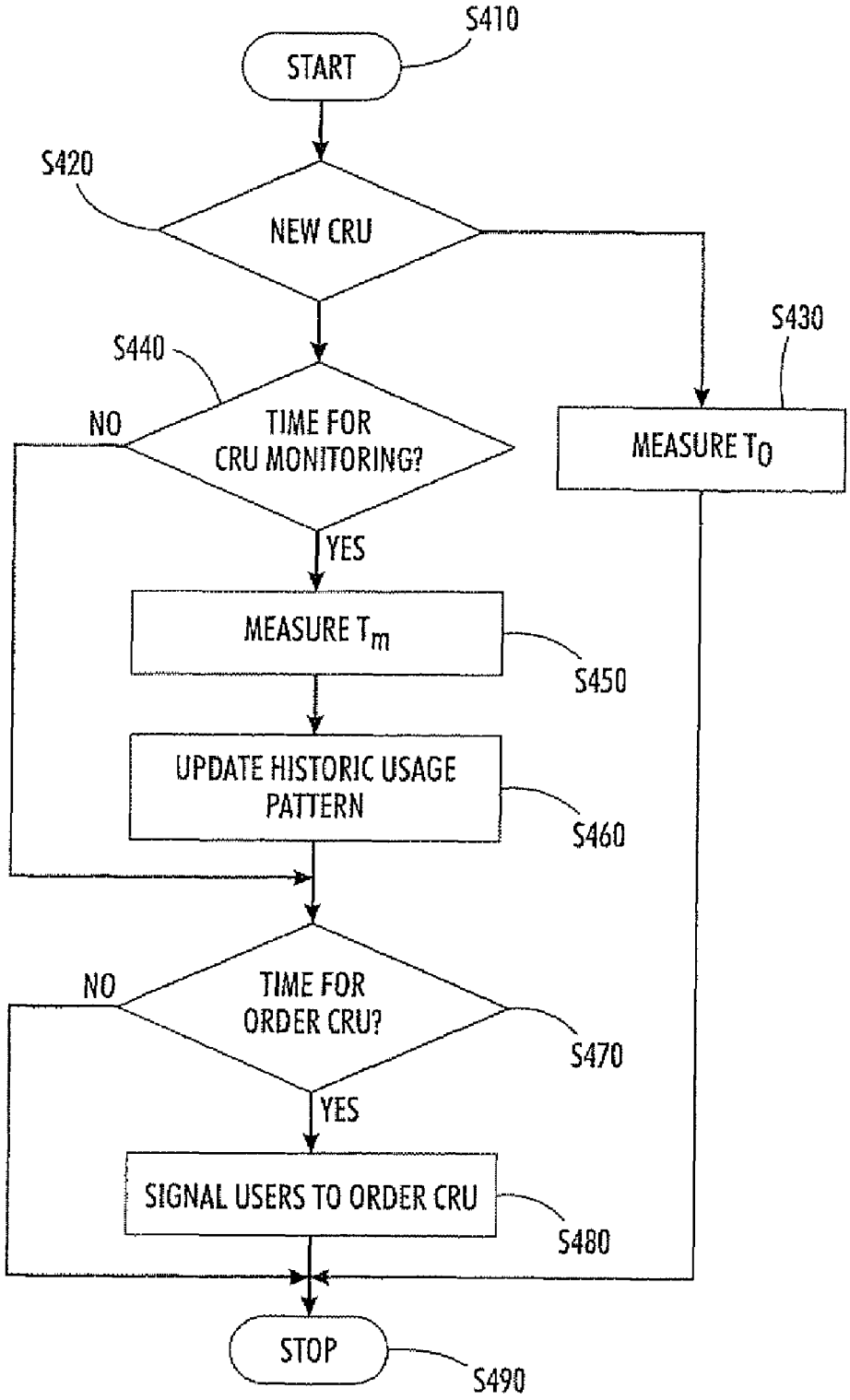
FIG. 4 shows a flow chart outlining an exemplary process for using a CRU.

FIG. 4 shows a flow chart outlining an exemplary process for using a CRU in a printing system. The process starts at step S410 and proceeds to step S420.

In step S420, a controller of the printing system may determine whether the CRU is newly installed. When the CRU is newly installed, the process proceeds to step S430; otherwise, the process proceeds to step S440.

In step S430, the controller may instruct a monitor module to initially measure a usage attribute of the CRU. Alternatively, the controller may read an initial usage attribute from a memory medium, such as a memory chip, attached with the CRU. Then, the process proceeds to step S490 and terminates.

In step S440, the controller may determine whether it is time to measure the usage attribute of the CRU. In an embodiment, the controller may measure the usage attribute periodically. The controller may set up a timer, and determine the time to measure based on the timer. When it is time to measure the usage attribute, the process proceeds to step S450; otherwise, the process proceeds to step S470.

In step S450, the controller may instruct the monitor module to measure the usage attribute of the CRU. Then, the process proceeds to step S460.

In step S460, the controller may update the historic usage pattern with the newly measured usage attribute. The controller may use any algorithms to characterize the historic usage pattern. In an example, the controller may characterize the historic usage pattern based on the initial measurement and the most recent measurement of the usage attribute. Then, the process proceeds to step S470.

In step S470, the controller may determine whether it is time to order a new CRU based on the historic usage pattern. For example, the controller may use Eq. 2 to calculate a remaining time of the present CRU. When the remaining time is substantially equivalent to or smaller than a threshold, the controller may determine that it is time to order the new CRU. When the remaining time is larger than the threshold, the controller may determine that it is not time yet. When it is time to order the new CRU, the process proceeds to step S480; otherwise, the process proceeds to S490, and terminates.

In step S480, the controller may instruct a signal mechanism, such as a display mechanism, to inform users for ordering a new CRU. Then, the process proceeds to step S490, and terminates.

It is noted the above process can be repetitively executed by the printing system. In addition, the above process may be suitably adjusted, such as skipping steps, adding steps, switching sequence of steps, and the like.

It will be appreciated that various of the above-disclosed and other features and functions, or alternatives thereof, may be desirably combined into many other different systems or applications. Also, various presently unforeseen or unanticipated alternatives, modifications, variations or improvements therein may be subsequently made by those skilled in the art, and are also intended to be encompassed by the following claims.

What is claimed is:

1. A method for replacing a customer replaceable unit (CRU) in a printing system, comprising:

determining a historic usage pattern for a photoreceptor during a usage of the photoreceptor, the historic usage pattern for the photoreceptor being determined as an amount of use of the photoreceptor per a unit of time, a usage attribute is an imaging layer thickness of the photoreceptor;

periodically measuring the imaging layer thickness of the photoreceptor according to saturation charging;

plotting the imaging layer thickness of the photoreceptor as a function of time between periodic measurements to obtain a resultant plot;

calculating a remaining time for the photoreceptor based on a relationship between the imaging layer thickness and time from the resultant plot; and signaling a user for ordering a new photoreceptor when the remaining time for the photoreceptor is substantially equivalent to a pre-determined value.

2. The method according to claim 1, wherein determining the historic usage pattern for the photoreceptor during the usage of the photoreceptor, further comprises:

determining the historic usage pattern based on at least one of a linear model, a polynomial model, and a least square fitting algorithm applied to the resultant plot.

3. The method according to claim 1, wherein determining the historic usage pattern for the photoreceptor during the usage of the photoreceptor, further comprises:

calculating a historic wear rate for the photoreceptor as an amount of wear of the photoreceptor per the unit of time.

4. The method according to claim 1, wherein calculating the remaining time for the photoreceptor based on the historic usage pattern, further comprises:

dynamically calculating the remaining time for the photoreceptor based on the historic usage pattern that is updated with a most recent measurement of the imaging layer thickness.

5. The method according to claim 1, further comprising:

obtaining a parameter of maximum wear amount from the photoreceptor.

6. A printing system, comprising:

a photoreceptor that is user replaceable;

a monitor device that (a) measures an initial imaging layer thickness of the photoreceptor, (b) periodically measures the imaging layer thickness according to saturation charging and (c) plots the imaging layer thickness of the photoreceptor as a function of time between periodic measurements to obtain a resultant plot; and a controller module configured to (1) determine a historic usage pattern for the photoreceptor based on the imaging layer thickness of the photoreceptor, the historic usage pattern for the photoreceptor being determined as a change in the imaging layer thickness of the photoreceptor per a unit of time, (2) calculate a remaining time for the photoreceptor based on a relationship between the imaging layer thickness and time from the resultant plot; and (3) signal a user for ordering a new photoreceptor when the remaining time for the photoreceptor is substantially equivalent to a pre-determined value.

7. The printing system according to claim 6, wherein the controller module is further configured to determine the historic usage pattern based on at least one of a linear model, a polynomial model, and a least square fitting algorithm applied to the resultant plot.

8. The printing system according to claim 6, further comprising a memory device storing a parameter for maximum wear amount of the photoreceptor.

9. The printing system according to claim 6, wherein the controller module is further configured to dynamically calculate the remaining time for the photoreceptor based on the historic usage pattern that is updated with a most recent imaging layer thickness measurement.

10. A non-transitory computer readable medium storing program instructions for causing a controller to perform a customer replaceable unit (CRU) optimization method, comprising:

determining a historic usage pattern for a photoreceptor during a usage of the photoreceptor, the historic usage pattern for the photoreceptor being determined as an amount of use of the photoreceptor per a unit of time;

periodically measuring an imaging layer thickness of the photoreceptor according to saturation charging;

plotting the imaging layer thickness of the photoreceptor as a function of time between periodic measurements to obtain a resultant plot;

calculating a remaining time for the photoreceptor based on a relationship between the imaging layer thickness of the photoreceptor and time from the resultant plot; and signaling a user for ordering a new photoreceptor when the remaining time for the photoreceptor is substantially equivalent to a pre-determined value.

11. The non-transitory computer readable medium according to claim 10, the CRU optimization method further comprising:

determining the historic usage pattern based on at least one of a linear model, a polynomial model, and a least square fitting algorithm applied to the resultant plot.

12. The non-transitory computer readable medium according to claim 10, the CRU optimization method further comprising:

calculating a historic wear rate for the photoreceptor based on an initial imaging layer thickness measurement and a most recent imaging layer thickness measurement, the historic wear rate for the photoreceptor being an amount of wear of the photoreceptor per the unit time.

13. The non-transitory computer readable medium according to claim 10, the CRU optimization method further comprising:

dynamically calculating the remaining time for the photoreceptor based on the historic usage pattern that is updated with a most recent measurement of the imaging layer thickness.

14. The non-transitory computer readable medium according to claim 10, the CRU optimization method further comprising:

reading a parameter of maximum wear amount from the photoreceptor.

* * * * *